United States Patent [19]

Yoshihara

[11] Patent Number: 4,580,018

[45] Date of Patent: Apr. 1, 1986

[54] SWITCH DEVICE

[75] Inventor: Fumiharu Yoshihara, Miyagi, Japan

[73] Assignee: Alps Electric Co., Ltd., Tokyo, Japan

[21] Appl. No.: 656,783

[22] Filed: Oct. 1, 1984

[30] Foreign Application Priority Data

Sep. 30, 1983 [JP] Japan ..... 58-150592[U]

[51] Int. Cl.[4] ..... H01H 9/00; H01H 13/70

[52] U.S. Cl. ..... 200/5 A; 200/159 B; 200/292; 200/294

[58] Field of Search ..... 200/5 R, 5 A, 159 B, 200/314, 329, 293–295; 235/145 R

[56] References Cited

U.S. PATENT DOCUMENTS

| | | | |
|---|---|---|---|
| 3,538,286 | 11/1970 | Michaelson, Jr. | 200/294 |
| 3,890,480 | 6/1975 | Berling et al. | 200/302 |
| 4,271,333 | 6/1981 | Adams et al. | 200/5 A X |
| 4,302,647 | 11/1981 | Kandler et al. | 200/5 A X |
| 4,323,740 | 4/1982 | Balash | 200/5 A |
| 4,348,557 | 9/1982 | Sado | 200/5 A |
| 4,365,130 | 12/1982 | Christensen | 200/5 A X |
| 4,421,966 | 12/1983 | Pounds | 200/5 A X |
| 4,490,587 | 12/1984 | Miller et al. | 200/5 A |
| 4,523,060 | 6/1985 | Maguire | 200/5 A |

*Primary Examiner*—J. R. Scott

*Attorney, Agent, or Firm*—Guy W. Shoup

[57] ABSTRACT

A switch device comprises a chassis with a number of key-tops, a switch unit, and a support board, piled up in that order and coupled at their centers by one screw. Plural screws pass through elongated screw holes bored in the support board and oriented radially around the center and are threaded to bosses of the chassis. The bosses pass loosely thru-holes bored in the switch unit.

4 Claims, 5 Drawing Figures

SWITCH DEVICE

FIELD OF THE INVENTION

The present invention relates to a switch device such as a keyboard switch and, particularly, to a switch device provided with a switch unit consisting of an upper electrode, a spacer, and a lower electrode stacked in order.

BACKGROUND OF THE INVENTION

As an example of such switch devices of the prior art, the structure shown in FIGS. 1 through 3 is known. Specifically, the switch device shown in perspective view in FIG. 1 includes overlay-finished display board 1 provided with a number of key-tops 2, switch unit 3, double-sided adhesive tape 4 used to adhere the display board 1 to the switch unit 3, metal support board 5, made of iron or the like, and double-sided adhesive tape 6 used to adhere the switch unit 3 and the support board 5 one to another. These structural members are stacked in such an order as shown in the drawing, and the double-sided adhesive tape 4 is formed with square-shaped openings 7 at positions corresponding to those of the key-tops 2 of the display board 1.

The switch unit 3 is structured as shown in FIGS. 2 and 3, and comprises a flexible upper electrode 10 having on the under surface of an insulating film 8 contact portions 9 at positions corresponding to those of the key-tops 2 of the display board 1, an electrically insulating spacer 12 made of paper, synthetic resin film and the like and having thru-holes 11 at positions corresponding to those of the key-tops 2, and a lower electrode 15 having on the upper surface of an insulating film 13 contact portions 14 at positions correponding to those of the key-tops 2, these elements being piled up in that order. Accordingly, each contact portion 9 of the upper electrode 10 and corresponding contact portion 14 of the lower electrode 15 are facing one another within the thru-hold 11 of the spacer 12. Incidentally, each contact portion 9 of the upper electrode 10 and each contact portion 14 of the lower electrode 15 are connected, as shown in FIG. 1, through flexible cables 16, 17 to a control section (not shown).

FIG. 2 illsutrates the state of the switch unit 3 where the key-top 2 of the display board 1 is not depressed, so that the contact portions 9, 14 are spaced apart from one another by the spacer 12 interposed between the upper electrode 10 and the lower electrode 15 and, thus, the switch is in the off state.

If any key-top 2 of the display board 1 is pushed by the finger, in response thereto the upper electrode 10 is locally depressed as shown in FIG. 3 and the contact portion 9 of the upper electrode 10 comes into contact with the contact portion 14 of the lower electrode 15 thereby resulting in the switch-on state. As the finger is lifted from the key-top 2 of the display board 1, owing to the recovery force of the upper electrode 10, the contact portion 9 separates from the contact portion 14 and the switch-off state is restored.

According to the conventional switch device of the foregoing construction, because the display board 1, the switch unit 3 and support board 5 mutually differring in the rate of thermal expansion are overlaid, these members exhibit different rates of expansion/contraction in response to variation in temperature. Specifically, since the switch unit 3 and the support board 5 having significantly different rates of thermal expansion are bonded together in a wholescale way by the double-sided adhesive tape 6, as the switch unit 3 expands or contracts in response to variation in temperature, camber or wrinkles appear on the switch unit 3 and a positional slippage would occur between the contact portion 9 of the upper electrode 10 and the contact portion 14 of the lower electrode 15, thus, making the performance of the contacts inferior.

SUMMARY OF THE INVENTION

It is an object of the present invention to dissolve the foregoing drawbacks of the prior art, thus, to provide a switch device without a fear of causing positional slippage between paired contact portions of an upper electrode and a lower electrode even though a switch unit expands or contracts in response to variation in temperature.

In order to achieve the foregoing object, the present invention resides in a switch device which comprises a number of key-tops provided on a chassis made from synthetic resin, a switch unit consisting of an upper electrode; an electrically insulating spacer; and a lower electrode stacked in order, and a metallic support board for supporting the switch unit, and operates in such a manner that in response to depression of the key-top, the upper electrode and the lower electrode come into electrical contact one with another. In addition, the present invention is characterized in that the chassis, the switch unit, and the support board are coupled together at their respective center positions, the support board is bored with plural elongated screw holes which are arranged in lines oriented in the radial directions with the coupling portion as the center. Screws are passed through these screw holes to fasten the support board to the chassis at screw set portions, and the switch unit is bored with thru-holes through which the screw set portions pass loosely.

DETAILED DESCRIPTION OF THE INVENTION

The embodiment of the present invention will be described with reference to the drawings.

Figure 4:
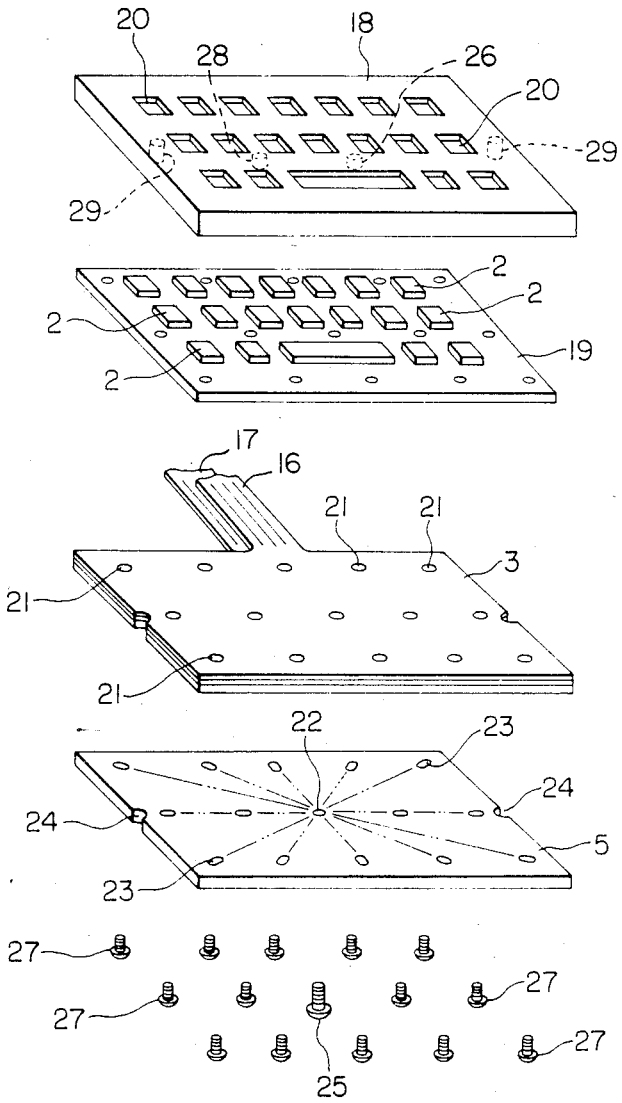
FIG. 4 is an exploded perspective view of an embodical switch device according to the present invention.

FIG. 4 is an exploded perspective view of the embodical switch device according to the present invention. In this drawing, a chassis 18 made from synthetic resin is bored with openings 20 in which key-tops 2 formed on a flexible rubber sheet 19 are inserted, and plural thru-holes 21 are bored in a switch unit 3 illustrated below the rubber sheet 19. In a metallic support board 5 made from iron and the like there are bored a center coupling hole 22 and plural oval-shaped screw holes 23 which are arranged in lines oriented in radial directions with the coupling hole as the center, and, in addition, positioning grooves 24 are formed at the centers of both, left and right, edges of the support board 5.

Further, on the under surface of the chassis 18 there are provided projectingly a boss 26 and plural bosses 28 corresponding in position to the coupling hole 22 and screw holes 23 of the support board 5, as well as a pair of positioning pins 29 corresponding in position to the grooves 24.

Assembly of the chassis 18, rubber sheet 19, switch unit 3, and support board 5 is performed in such a way that, first, the switch unit 3 is placed on the chassis 18 with the rubber sheet 19 assembled thereto, and the center thru-hole 21 of the switch unit 3 is fitted about the center boss 26 of the chassis 18 thereby both being positioned. Then, the support board 5 is placed on the switch unit 3, the center coupling hole 22 of the support board 5 is fitted about the center boss 26 of the chassis 18, and a coupling screw 25 is threaded into the boss 26, whereby the three, chassis 18, switch unit 3 and support board 5, are coupled at the center. Incidentally, since it is difficult to accord the coupling hole 22 of the support board with the boss 26 of the chassis 18 because of the support board 18 being opaque, in accordance with the present embodiment, the positioning of the support board 5 is easily achieved by using the positioned pins 29 formed on the under surface of the chassis 18 and causing the grooves 24 of the support board 5 to engage these positioning pins 29.

Figure 1:
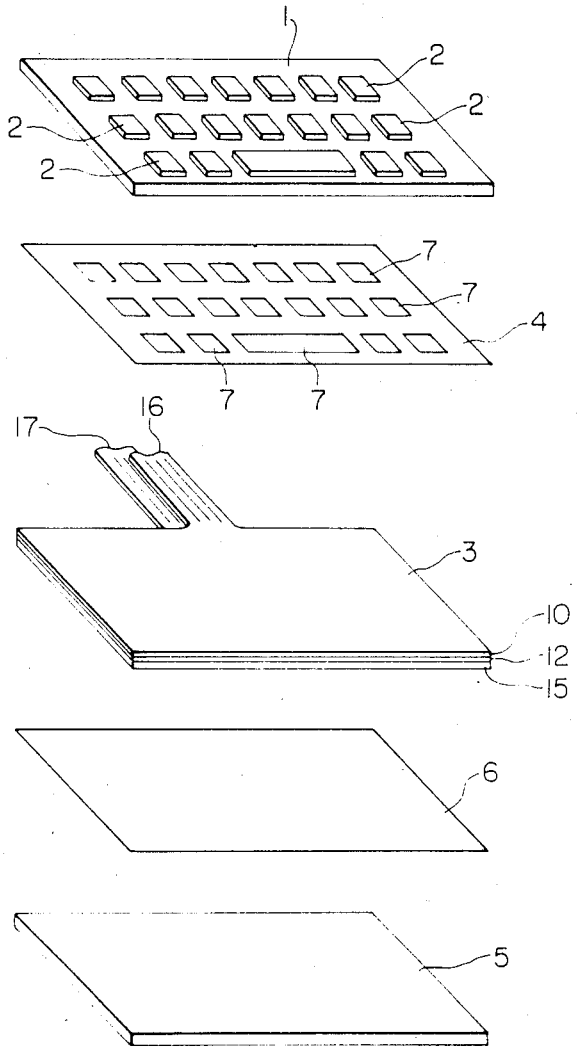
FIG. 1 PRIOR ART
FIG. 1 is an exploded perspective view of the conventional switch device.
Figure 2:
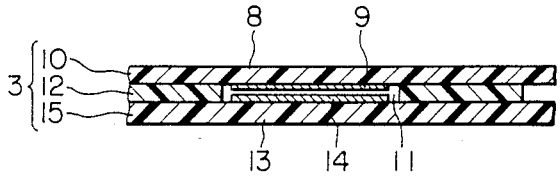
FIG. 2 PRIOR ART
FIGS. 2 and 3 are enlarged cross sectional views of the important portion of the conventional switch device.
Figure 3:
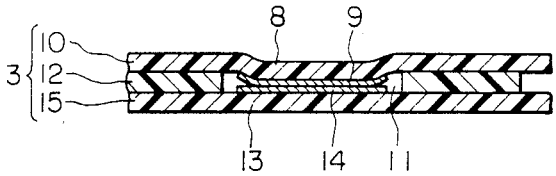
FIG. 3 PRIOR ART
Figure 5:
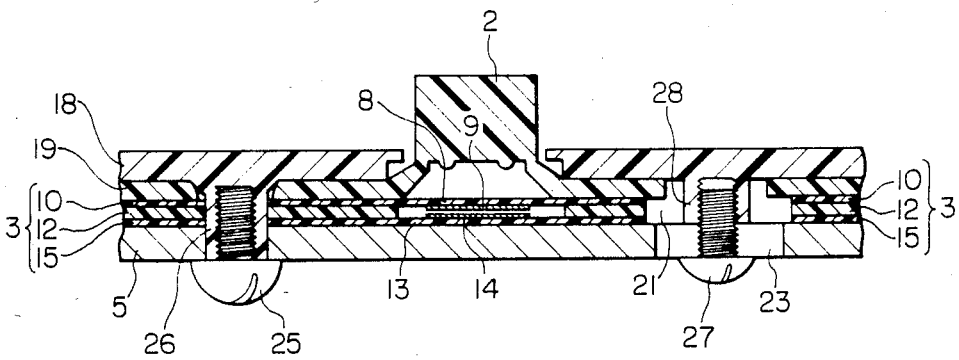
FIG. 5 is an enlarged cross sectional view of the important portion of the switch device shown in FIG. 4.

Then plural screws 27 are inserted in the respective screw holes 23 from the under side of the support board 5 and, as shown in FIG. 5, threaded into the corresponding bosses 28 of the chassis 18 to secure the support board 5 and the chassis 18 together. At this place, because the diameter of the thru-hole 21 of the switch unit 3 is designed so as to be a little larger than the diameter of the boss 28 of the chassis 18, there remains a gap between the boss 28 and the thru-hole 21.

FIG. 5 illustrates the switch-off state, and the contact portion 9 of the upper electrode 10 and the contact portion 14 of the lower electrode 15 are spaced apart from one another by a spacer 12. As the key-top 2 is pushed by the finger the contact portion 9 comes into contact with the contact portion 14 resulting in the switch-on state, or, as the finger is lifted from the key-top 2 the switch-off states recovers. This manner of operation is the same as that of the foregoing conventional structure.

In the switch device of the present invention having the foregoing structure, because the gap remains between the boss 28 of the chassis 18 and the thru-hole 21 of the switch unit 3, even if the insulating films 8 and 13 and the spacer 12 of the switch unit 3 expand or contract in response to variation in temperature, this expansion/contraction can not be disturbed by the bosses 28. In addition, because an adhesive agent such as a both-side-adhesive tape is not employed to secure the switch unit 3, there is no fear that camber or wrinkles would appear on the insulating films 8 and 13 and a positional slippage would occur between the contact portions 9 and 14.

Moreover, even though the chassis 18 made from synthetic resin and screwed to the metallic support board 5 under goes expansion and contraction in response to variation in temperature, because the direction of expansion/contraction is in accord with the radial directions around the center, the screws 27 threaded to the bosses 28 can move along the screw holes 23 which are arranged in lines oriented in the radial directions around the center of the support board 5; thus, there is no fear that the screws 27 would disturb the expansion/contraction of the chassis 18 and apply an unreasonable force to the same.

As apparent from the foregoing description, according to the switch device of the present invention, the chassis, switch unit and support board differing in the rate of thermal expansion are secured together by means of the screws, not by an adhesive agent such as a double-sided adhesive tape, and the expansion/contraction resulting from the variation in temperature is taken into consideration in the design of screwing. Therefore, there is no fear that camber or wrinkles would appear on the switch unit and, in turn, the respective contact portions of the upper and lower electrodes would cause positional slippage to result in imperfect contact, thus, the present invention can realize always a favourable switching operation.

While the preferred embodiment has been described, variations thereto will occur to those skilled in the art within the scope of the present inventive concepts which are delineated by the following claims.

What is claimed is:

1. A switch device including a display board provided with a plurality of key-tops arranged thereon, a switch unit arranged below said display board having an upper electrode layer, an insulting spacer layer with a plurality of contact-forming holes therein, and a lower electrode layer, forming a plurality of switch elements arranged correspondingly with said key-tops, and a support board below said switch unit, wherein the improvement comprises:

said display board having downwardly extending therefrom a center mounting portion located in the center thereof and a plurality of screw mounting portions which are aligned radially from said center mounting portion, said switch unit having a corresponding center mounting and screw mounting thru-holes, and said support board having a plurality of corresponding center mounting and screw mounting holes, for assembling said display board, switch unit, and support board together in the described order, and further wherein said thru-holes of said switch unit are enlarged compared to said screw mounting portions such that the latter are passed therethrough with a clearance to accommodate any thermal expansion.

2. The switch device described in claim 1 wherein said key-tops are formed integrally on a flexible rubber sheet and said display board has a plurality of corresponding openings for extending said key-tops therethrough.

3. A switch device as set forth in claim 1, wherein said switch unit and said support board are formed with grooves, said display board is provided with positioning pins corresponding in position to said grooves,

1 whereby positioning of said, display board said switch unit and said support board in assembling them is smoothly performed by means of said grooves and said positioning pins.

4. A switch device as set forth in claim 1, wherein said screw mounting portions are bosses formed integrally on said chassis.

* * * * *